US011700479B2

(12) United States Patent
Ito

(10) Patent No.: US 11,700,479 B2
(45) Date of Patent: Jul. 11, 2023

(54) ACOUSTIC DEVICE

(71) Applicant: Alps Alpine Co., LTD, Tokyo (JP)

(72) Inventor: Ryo Ito, Fukushima (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/560,537

(22) Filed: Dec. 23, 2021

(65) Prior Publication Data

US 2022/0210546 A1 Jun. 30, 2022

(30) Foreign Application Priority Data

Dec. 28, 2020 (JP) ..... 2020-218513

(51) Int. Cl.
*H04R 1/28* (2006.01)
*H04R 1/02* (2006.01)
*H04R 7/12* (2006.01)

(52) U.S. Cl.
CPC ..... *H04R 1/2873* (2013.01); *H04R 1/026* (2013.01); *H04R 7/12* (2013.01)

(58) Field of Classification Search
CPC ..... H04R 1/2873; H04R 1/026; H04R 7/12
See application file for complete search history.

(56) References Cited

U.S. PATENT DOCUMENTS

2006/0002579 A1* 1/2006 Watanabe ..... H04R 7/12 381/403
2006/0104472 A1 5/2006 Abe et al.
2009/0003632 A1 1/2009 Lin

FOREIGN PATENT DOCUMENTS

EP 2 978 243 A1 1/2016
JP 2005 151210 A 6/2005
JP 2006109019 A * 4/2006
JP 2006-148447 6/2006

OTHER PUBLICATIONS

Translation of JP2006109010A Apr. 20, 2006 Kato.*
European search report from corresponding European Application No. 21213513.1, dated May 31, 2022, 8pp.

* cited by examiner

*Primary Examiner* — Andrew L Sniezek
(74) *Attorney, Agent, or Firm* — Crowell & Moring LLP

(57) ABSTRACT

An acoustic device includes a main body case, a vibrating body provided inside of the main body case, a magnetic circuit unit disposed in front of the vibrating body in a sound emitting direction of the vibrating body, a coil located inside of a magnetic gap of the magnetic circuit unit, a bobbin configured to support the coil and vibrate along with the vibrating body, and a damper configured to connect the main body case to the bobbin. The damper is disposed in the rear of the vibrating body, and a damper regulation unit is provided in the rear of the damper at a position facing the damper.

17 Claims, 4 Drawing Sheets

ACOUSTIC DEVICE

RELATED APPLICATION

The present application claims priority to Japanese Patent Application Number 2020-218513, filed Dec. 28, 2020, the entirety of which is hereby incorporated by reference.

BACKGROUND

1. Field of the Invention

The present invention relates to an acoustic device having a magnetic circuit unit disposed in front of a vibrating body in a direction of sound emission.

2. Description of the Related Art

JP 2006-148447 A describes a loudspeaker system in which a magnetic circuit is disposed on the sound emitting side of a diaphragm in order to reduce the space required to mount a loudspeaker.

In the loudspeaker system, a buffer member having a buffering function is provided near the lower end of the outer circumferential wall of the yoke or on the upper surface of a stepped portion of the diaphragm. Even if the diaphragm moves with a large amplitude, the diaphragm collides with the yoke facing the diaphragm via the buffer member and, thus, significant damage of the diaphragm can be prevented.

According to the invention described in JP 2006-148447 A, when the diaphragm moves with a large amplitude due to an excessive input to the voice coil, the diaphragm collides with the yoke via the buffer member. This structure prevents significant damage to the diaphragm. However, since collision of the diaphragm does occur, it is difficult to completely prevent damage to the diaphragm. If even a small area of damage occurs to the diaphragm, the acoustic characteristics in the emitted sound frequency range may deteriorate.

SUMMARY

Accordingly, it is an object of the present disclosure to provide an acoustic device capable of preventing damage to the diaphragm and deterioration of the acoustic characteristics even if the diaphragm moves with a large amplitude due to an excessive input to a voice coil.

According to the present disclosure, an acoustic device includes a main body case, a vibrating body provided inside of the main body case, a magnetic circuit unit disposed in front of the vibrating body, a coil located inside of a magnetic gap of the magnetic circuit unit, a bobbin configured to support the coil and vibrate along with the vibrating body, and a damper configured to connect the main body case to the bobbin. The damper is disposed in the rear of the vibrating body, and a damper regulation unit is provided in the rear of the damper at a position facing the damper.

Preferably, the acoustic device of the present disclosure further includes a damper support portion to which an outer circumference of the damper is fixed. A distance that the coil moves rearward when the damper moves from a neutral position thereof until colliding with the damper regulation unit is less than a distance that the coil moves rearward when the vibrating body moves from a neutral position thereof until colliding with the damper support portion.

Preferably, according to the acoustic device of the present disclosure, a distance that the coil moves rearward when the damper moves from a neutral position thereof until colliding with the damper regulation unit is less than a distance that the coil moves forward when the bobbin moves from a neutral position thereof until colliding with the magnetic circuit unit.

Preferably, according to the acoustic device of the present disclosure, a distance that the coil moves rearward when the damper moves from a neutral position thereof until colliding with the damper regulation unit is less than a distance that the coil moves forward when the vibrating body moves from a neutral position thereof until colliding with the magnetic circuit unit.

Preferably, according to the acoustic device of the present disclosure, in any one of cross sections of the acoustic device including a center line that passes through a winding center of the coil, the damper regulation unit is disposed so as to be line symmetrical about the center line.

Preferably, according to the acoustic device of the present disclosure, the damper is ring-shaped, and the bobbin is formed in a cylindrical shape, an inner circumference of the damper is bonded and fixed to the outer circumferential surface of the bobbin, and the damper regulation unit is provided on a radially outer side of the bobbin at a position facing the inner circumference of the damper.

Preferably, according to the acoustic device of the present disclosure, the damper regulation unit is formed as an integral part of the main body case.

According to the present disclosure, the acoustic device has a configuration in which a damper regulation unit is provided at a position in the rear of the damper so as to face the damper. Therefore, when the vibrating body moves with a large amplitude due to an excessive input to the voice coil, the damper collides with the damper regulation unit. As a result, no collision of the vibrating body occurs and, thus, damage to the vibrating body can be prevented. Consequently, deterioration of the acoustic characteristics can be prevented.

DESCRIPTION OF THE PREFERRED EMBODIMENTS

An acoustic device 1 according to an embodiment of the present invention is described with reference to FIGS. 1 to 4. In terms of the acoustic device 1, the Y1 direction is a forward direction that is a sound emitting direction, and the Y2 direction is a rearward direction that is opposite to the sound emitting direction. A center line O extending in the sound emitting direction is illustrated in FIGS. 1 to 4.

Figure 1:
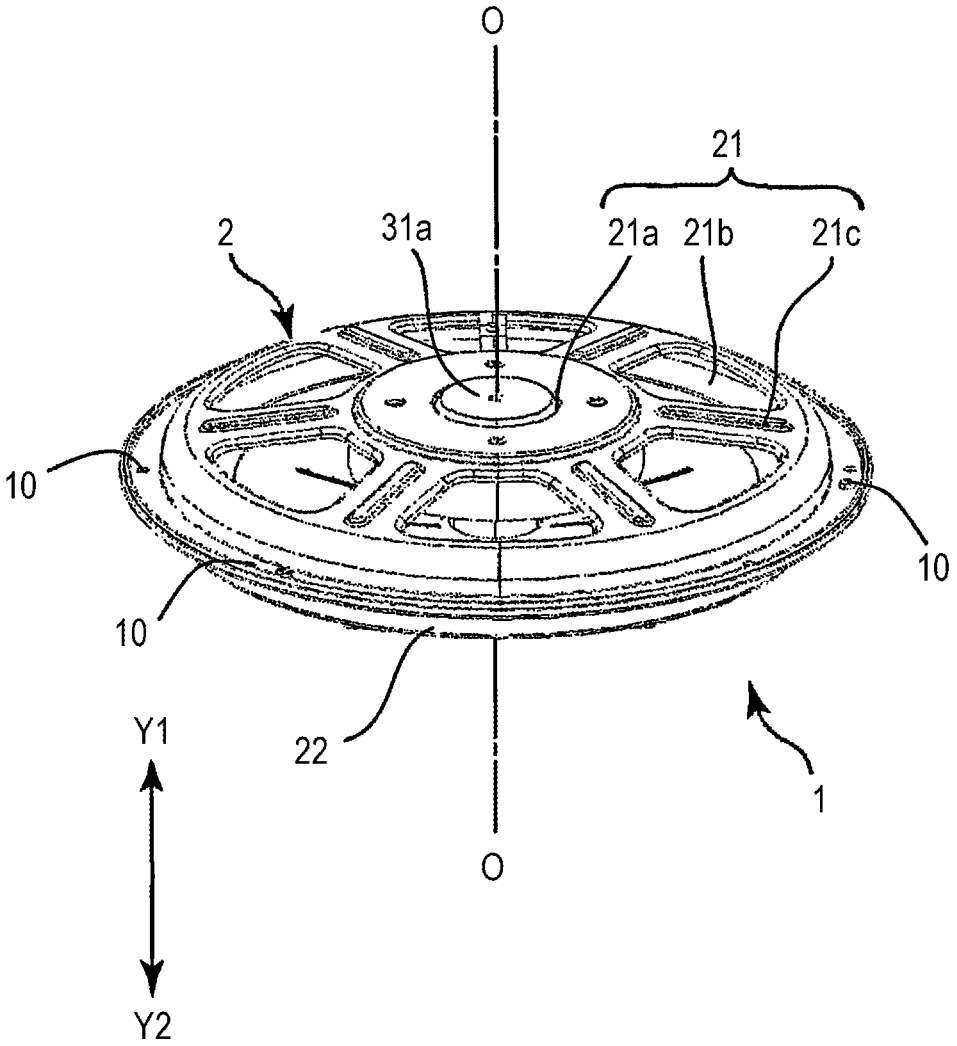
FIG. 1 is a perspective view of the external appearance of an acoustic device according to an embodiment of the present invention.
Figure 2:
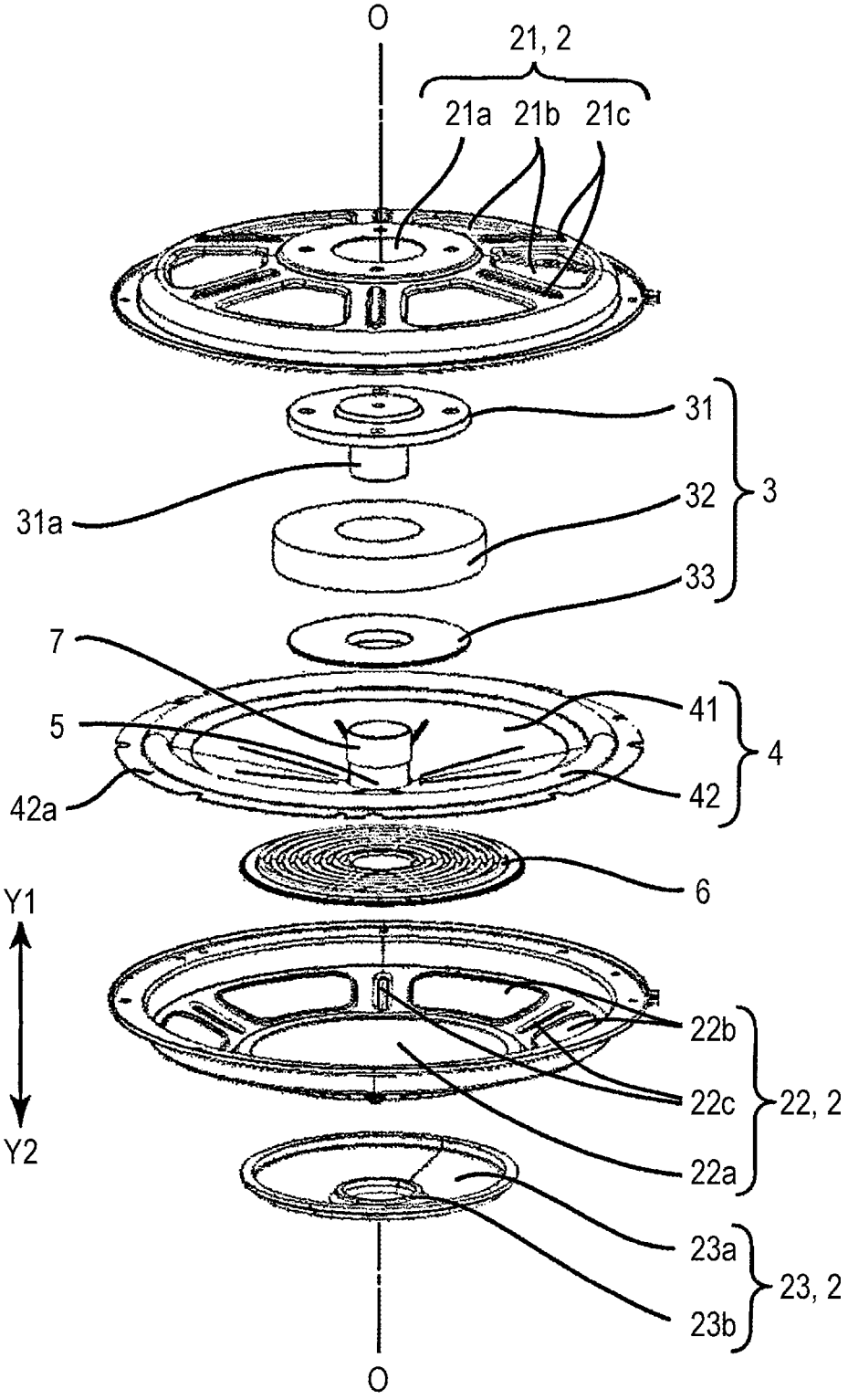
FIG. 2 is an exploded perspective view of the acoustic device illustrated in FIG. 1.

As illustrated in FIG. 1, the acoustic device 1 includes a main body case 2. As illustrated in FIG. 2, the main body case 2 includes a front case 21, a rear case 22, and a cover member 23. As illustrated in FIG. 1, the front case 21 and the rear case 22 are fastened to each other by screw fastening portions 10 provided at multiple locations in the outer circumferential portion of the front case 21 and the outer circumferential portion of the rear case 22. The front case 21 and the rear case 22 are formed by injection molding using a synthetic resin material or by die casting molding using a light metal material.

As illustrated in FIG. 2, a front central hole 21*a* is formed in the center of the front case 21. In addition, a plurality of front openings 21*b* are formed around the front central hole 21*a* in a radial way, and a front partition 21*c* is formed to partition every two of the front openings 21*b* from each other. In addition, as illustrated in FIG. 2, a rear central hole 22*a* is formed in the center of the rear case 22. Furthermore, a plurality of rear openings 22*b* are formed around the rear central hole 22*a* in a radial manner, and a rear partition 22*c* is formed to partition every two of the rear openings 22*b* from each other. The cover member 23 is attached to the rear case 22 from the rear (in the Y2 direction) so as to cover the rear central hole 22*a*. Alternatively, the cover member 23 may be an integral part of the rear case 22.

Figure 3:
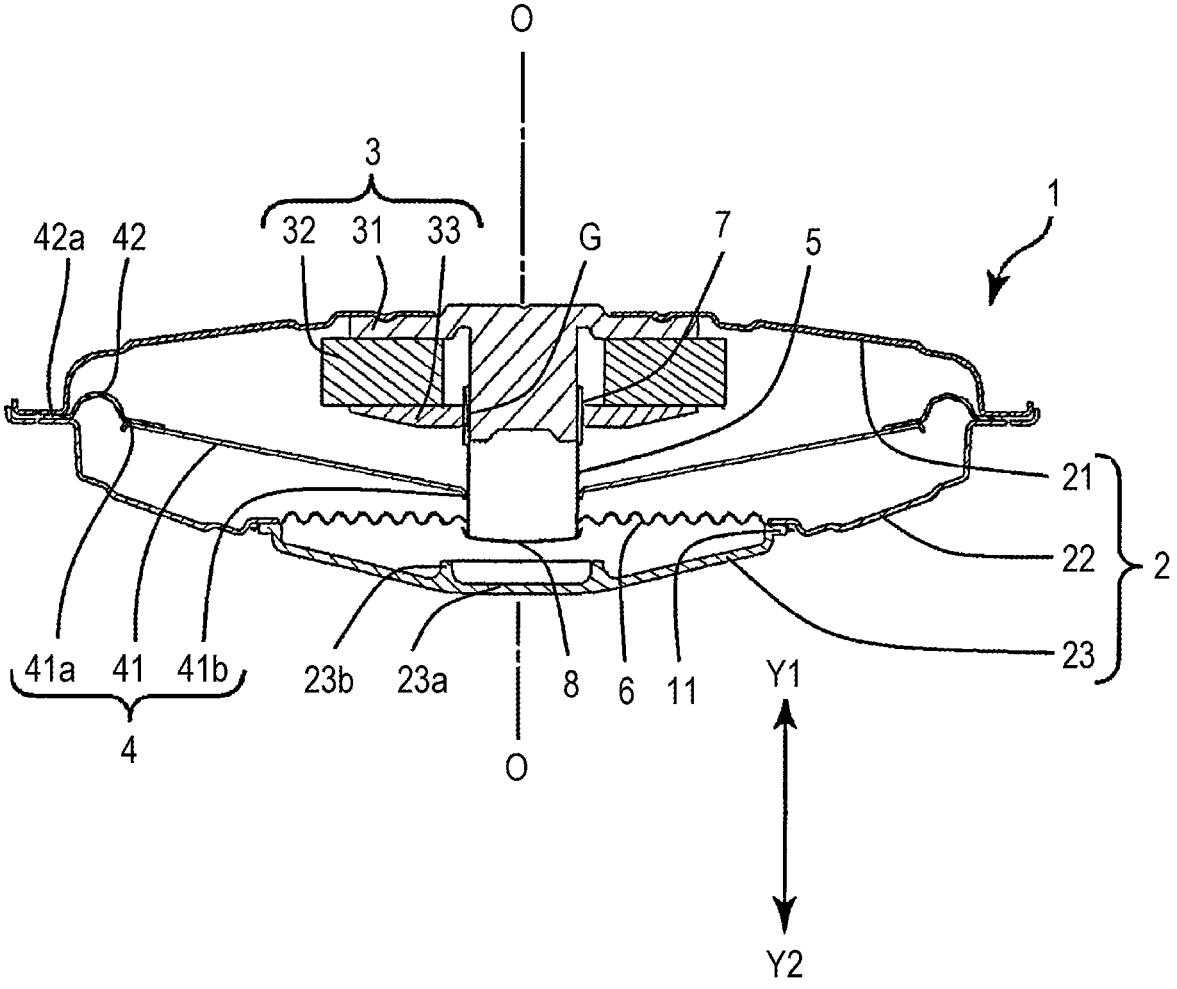
FIG. 3 is a cross-sectional view of the acoustic device illustrated in FIG. 1.

As illustrated in FIGS. 2 and 3, a magnetic circuit unit 3 is fixed to the rear surface of the front case 21 facing rearward (the Y2 direction). The magnetic circuit unit 3 includes a yoke 31, a magnet 32 to which the rear surface of the yoke 31 facing rearward (the Y2 direction) is joined, and a plate 33 to which the rear surface of the magnet 32 facing rearward (the Y2 direction) is joined. The front surface of the yoke 31 facing forward (the Y1 direction) is bonded and fixed to the rear surface of the front case 21 facing rearward (the Y2 direction). The yoke 31 and the plate 33 are made of a magnetic material. In the center of the yoke 31, a center pole portion 31*a* protruding rearward (in the Y2 direction) is formed as an integral part of the yoke 31, and a magnetic gap G is formed between the outer circumferential surface of the center pole portion 31*a* and the inner circumferential surface of the ring-shaped plate 33.

As illustrated in FIGS. 2 and 3, a vibrating body 4 is provided inside the main body case 2 and in the rear of the magnetic circuit unit 3 (in the Y2 direction). The vibrating body 4 includes a diaphragm portion 41 and an edge portion 42. The edge portion 42 has a flexural rigidity in the direction of curvature that is the axial direction of every imaginary axis directed to the plane perpendicular to the center line O, and the flexural rigidity is lower than that of the diaphragm portion 41 in the same direction. The edge portion 42 is formed of rubber or by urethane or cloth impregnated with rubber. The flexural rigidity is the product of the modulus of longitudinal elasticity E and the cross-sectional secondary moment I.

An outer circumferential portion 41*a* of the diaphragm portion 41 is bonded to the edge portion 42. As illustrated in FIGS. 2 and 3, the outer end 42*a* of the edge portion 42 is sandwiched between the rearward (Y2 direction) facing surface of the outer circumferential portion of the front case 21 and the forward (Y1 direction) facing surface of the outer circumferential portion of the rear case 22.

The diaphragm portion 41 has the shape of a cone about the center line O and tapers rearward (in the Y2 direction). The outer circumferential surface of a cylindrical bobbin 5 is bonded and fixed to an inner circumferential portion 41*b* of the diaphragm portion 41.

As illustrated in FIG. 3, the outer circumferential surface of the rear side (in the Y2 direction) of the bobbin 5 and the main body case 2 are joined by a damper 6, which is corrugated in cross-section and is ring-shaped in plan view. The inner circumference of the damper 6 is bonded and fixed to the outer circumferential surface of the bobbin 5. The outer circumference of the damper 6 is clamped and fixed by a damper support portion 11 consisting of an inner circumferential portion of the rear case 22 and the outer circumferential portion of the cover member 23. However, the outer circumference of the damper 6 may be bonded and fixed to the forward (Y1 direction) facing surface of the inner circumferential portion of the rear case 22. In this case, the forward (Y1 direction) facing surface of the inner circumferential portion of the rear case 22 serves as the damper support portion. Due to the elastic deformation of the edge portion 42 and the damper 6, the cone-shaped diaphragm portion 41 is supported in a vibratable manner in the front-rear direction (the Y1-Y2 direction). A coil 7 is wound on the front end portion of the bobbin 5 facing forward (in the Y1 direction), and the coil 7 is located inside of the magnetic gap G. A cap 8 is bonded and fixed to the rear end portion facing rearward (in the Y2 direction) of the bobbin 5. Thus, the rear end is closed. Note that the center line O is an imaginary line that passes through the winding center of the coil 7, the center of the damper 6, and the center of the vibrating body 4 and further passes through the center of the magnetic circuit unit 3.

As illustrated in FIG. 3, a damper regulation unit 23*b* is disposed in the rear of the damper 6 (in the Y2 direction) on the radially outer side of the cylindrical bobbin 5 at a position that faces the inner circumference of the damper 6. The term "damper regulation unit 23*b*" refers to the spot where at least part of the damper 6 collides therewith first when the vibrating body 4 moves rearward (in the Y2 direction) from its neutral position (the position when no current is applied to the coil 7). According to the present embodiment, the damper regulation unit 23*b* is formed as an integral part of the cover member 23 of the main body case 2. The damper regulation unit 23*b* is formed so as to protrude forward (in the Y1 direction) from a base portion 23*a* of the cover member 23. It is desirable that the damper regulation unit 23*b* be disposed so as to be line symmetrical about the center line O in any cross section including the center line O passing through the winding center of the coil 7. The damper regulation unit 23*b* according to the present embodiment is formed in a ring shape along a continuous circle centered on the center line O. Note that the damper regulation unit 23*b* may be formed along an intermittent circle centered on the center line O.

Figure 4:
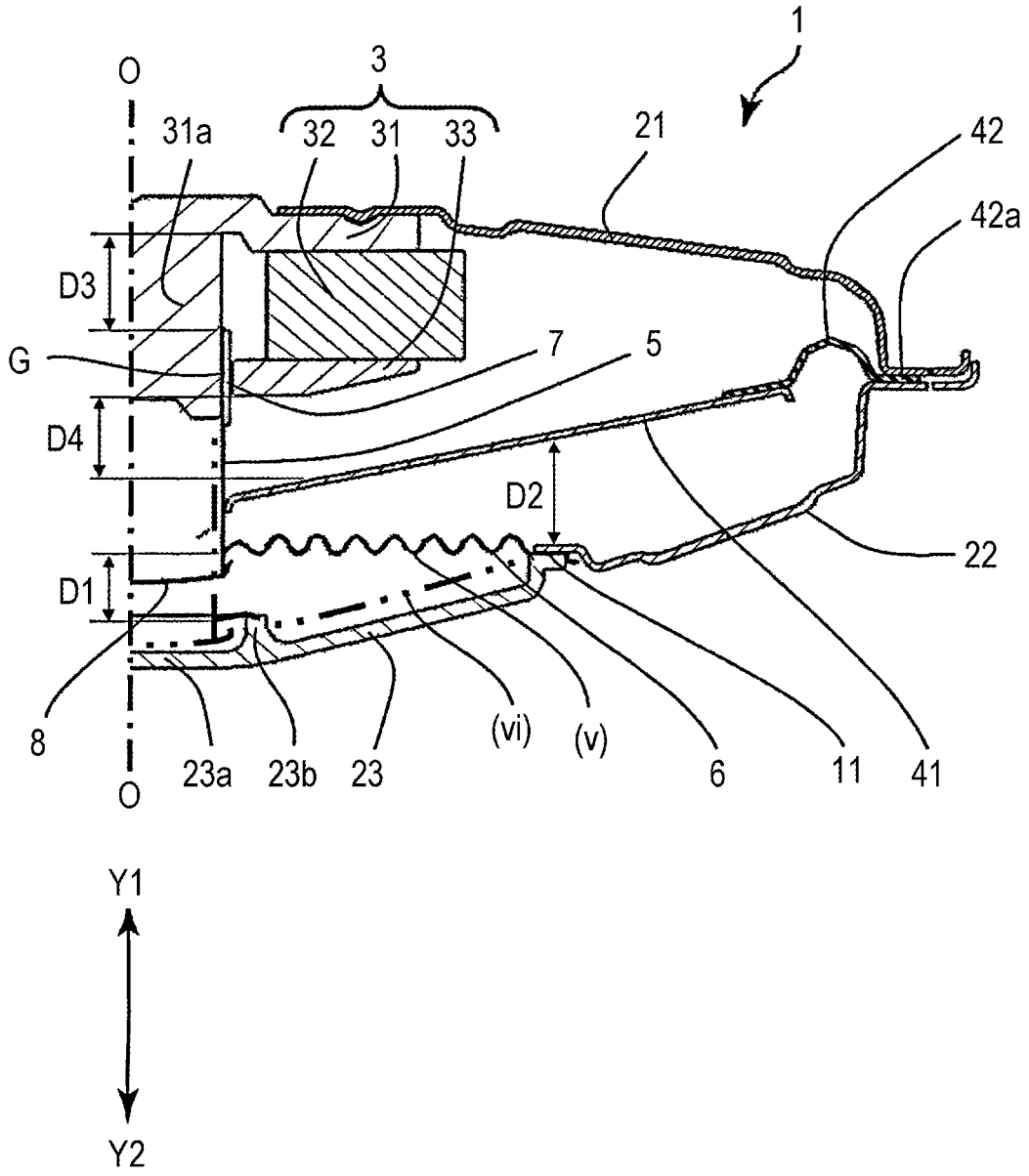
FIG. 4 is a half cross-sectional view used to describe the operation performed by the acoustic device illustrated in FIG. 1.

As illustrated in FIG. 4, a distance D1 that the coil 7 moves rearward when the damper 6 moves from its neutral position until colliding with the damper regulation unit 23*b* is less than a distance D2 that the coil 7 moves rearward when the diaphragm portion 41 of the vibrating body 4 moves from its neutral position (the position when no electric current is applied to the coil 7) until colliding with the damper support portion 11.

In addition, the distance D1 that the coil 7 moves rearward when the damper 6 moves from its neutral position until colliding with the damper regulation unit 23*b* is less than a distance D3 that the coil 7 moves forward when the bobbin 5 moves from its neutral position (the position when no electric current is applied to the coil 7) until colliding with the magnetic circuit unit 3. Furthermore, the distance D1 that the coil 7 moves when the damper 6 moves from its neutral position until colliding with the damper regulation unit 23*b* is less than a distance D4 that the coil 7 moves forward when the vibrating body 4 moves from its neutral position (the position where no electric current is applied to the coil 7) until colliding with the magnetic circuit unit 3.

The sound emitting operation performed by the acoustic device 1 is described below. When an electric current is applied to the coil 7, the electromagnetic force excited by the magnetic field and the electric current acting on the coil 7 in the magnetic circuit unit 3 vibrate the vibrating body 4 in the front-rear direction (the Y1-Y2 direction), and the sound pressure is given forward in the sound emitting direction (in the Y1 direction). In a normal sound emitting operation, the maximum distance that the vibrating body 4 and bobbin 5 in their neutral position move rearward (in the Y2 direction) is less than the distance D1 that the coil 7 moves rearward (Y2 direction) when the damper 6 moves from its neutral position until colliding with the damper regulation unit 23*b*. Therefore, in the normal sound emitting operation, the damper 6 does not collide with the damper regulation unit 23*b*, and the presence of the damper regulation unit 23*b* does not interfere with the normal sound emitting operation.

However, due to some reason, an excessive input signal may be input to the coil 7 of the acoustic device 1. In this case, the vibrating body 4 attempts to move in the front-rear direction (the Y1-Y2 direction) with a large amplitude. At this time, according to the acoustic device 1 of the present embodiment, the damper 6 collides with the damper regulation unit 23*b*, which restricts the vibrating body 4 from moving rearward (in the Y2 direction) any further. As illustrated in FIG. 4, the distance D1 that the coil 7 moves rearward when the damper 6 moves from its neutral position until colliding with the damper regulation unit 23*b* is less than the distance D2 that the coil 7 moves rearward until the diaphragm portion 41 of the vibrating body 4 collides with the damper support portion 11. Therefore, before the diaphragm portion 41 moves rearward (in the Y2 direction) and collides with the damper support portion 11, the damper 6 moves from its neutral position (v) to the position (vi) and collides with the damper regulation unit 23*b*. This structure avoids the diaphragm portion 41 from colliding with the damper support portion 11. As a result, according to the acoustic device 1 of the present embodiment, even if the diaphragm portion 41 moves rearward (in the Y2 direction) greatly, damage of the diaphragm portion 41 can be prevented. Note that when the damper 6 moves to the position (vi) and collides with the damper regulation unit 23*b*, the rear end of the bobbin 5 and the cap 8 are located on the radially inner side of the damper regulation unit 23*b* and, thus, do not collide with the base portion 23*a* and the damper regulation unit 23*b*.

In addition, according to the acoustic device 1 of the present embodiment, the damper regulation unit 23*b* is disposed so as to be line symmetrical about the center line O in any cross section including the center line O passing through the winding center of the coil 7. For this reason, when the damper 6 collides with the damper regulation unit 23*b*, the damper 6 is subjected to a reaction force in a line symmetric manner about the center line O. Consequently, the bobbin 5 does not tilt. This prevents the bobbin 5 and the coil 7 from colliding with the magnetic circuit unit 3 and being damaged due to the tilt of the bobbin 5.

In addition, according to the acoustic device 1 of the present embodiment, the damper 6 is ring-shaped, and the damper regulation unit 23*b* is provided so as to face the inner circumference of the damper 6. For this reason, the damper 6 and the damper regulating unit 23*b* collide with each other at a position close to where the bobbin 5 and the damper 6 are bonded and fixed to each other and have increased rigidity. As a result, the rearward movement of the vibrating body 4 (in the Y2 direction) can be reliably regulated.

In the normal sound emitting operation, the vibrating body 4 operates so as to have a reciprocating amplitude of vibration in the front-rear direction (the Y1-Y2 direction) about its neutral position. Therefore, by regulating the rearward (Y2 direction) movement of the vibrating body 4 with the damper regulation unit 23*b*, the forward (Y1 direction) movement of the vibrating body 4 can be regulated as well. As illustrated in FIG. 4, according to the acoustic device 1 of the present invention, the distance D1 that the coil 7 moves rearward when the damper 6 moves from its neutral position until colliding with the damper regulation unit 23*b* is less than the distance D3 that the coil 7 moves forward when the bobbin 5 moves until colliding with the magnetic circuit unit 3. When the vibrating body 4 vibrates in the front-rear direction with an excessive amplitude in the sound emitting operation, the damper 6 collides with the damper regulation unit 23*b*. Thus, the vibrating body 4 is prevented from vibrating in the front-rear direction with a further large amplitude. Therefore, the vibrating body 4 can also be prevented from moving forward (in the Y1 direction) greatly, and the bobbin 5 can be prevented from colliding with the yoke 31 of the magnetic circuit unit 3. This also prevents the vibrating body 4 from moving forward (in the Y1 direction) with excessive amplitude and prevents the bobbin 5 from being damaged.

In addition, the distance D4 that the coil 7 moves forward until the vibrating body 4 collides with the magnetic circuit unit 3 is less than the distance D1 that the coil 7 moves rearward when the damper 6 moves from its neutral position until colliding with the damper regulation unit 23*b*. Therefore, when the vibrating body 4 vibrates in the front-rear direction with an excessive amplitude, the forward movement of the vibrating body 4 (in the Y1 direction) can be prevented by preventing the rearward movement of the damper 6 by using the damper regulation unit 23*b*. In addition, collision of the diaphragm portion 41 of the vibrating body 4 with the magnetic circuit unit 3 can be prevented. Furthermore, this can prevent the diaphragm portion 41 from moving forward (in the Y2 direction) with excessive amplitude and being damaged.

According to the acoustic device 1 of the present invention, when the vibrating body 4 moves with a large amplitude due to an excessive input to the coil 7, the damper 6 and the damper regulation unit 23*b* collide with each other first. As a result, the vibrating body 4 does not collide with another part and, thus, damage of the diaphragm portion 41 can be prevented. Consequently, it is possible to prevent the acoustic characteristics from deteriorating.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An acoustic device comprising:

a main body case;

a vibrating body provided inside of the main body case;

a magnetic circuit unit disposed in front of the vibrating body;

a coil located inside of a magnetic gap of the magnetic circuit unit;

a bobbin configured to support the coil and vibrate along with the vibrating body; and a damper configured to connect the main body case to the bobbin, wherein the damper is disposed in the rear of the vibrating body, wherein a damper regulation unit is provided in the rear of the damper at a position facing the damper, the amplitude of vibration of at least one of the vibrating body and the bobbin being restricted by the damper contacting the damper regulation unit, and wherein an outer circumference of the damper is fixed to a damper support portion, and a distance that the coil moves rearward when the damper moves from a neutral position thereof until colliding with the damper regulation unit is less than a distance that the coil moves rearward when the vibrating body moves from a neutral position thereof until colliding with the damper support portion.

2. The acoustic device according to claim 1, wherein the bobbin is formed in a cylindrical shape, an inner circumference of the damper is bonded and fixed to an outer circumferential surface of the bobbin, and the damper regulation unit is provided on a radially outer side of the bobbin at a position facing the inner circumference of the damper.

3. The acoustic device according to claim 1, wherein a distance that the coil moves rearward when the damper moves from a neutral position thereof until colliding with the damper regulation unit is less than a distance that the coil moves forward when the bobbin moves from a neutral position thereof until colliding with the magnetic circuit unit.

4. The acoustic device according to claim 1, wherein a distance that the coil moves rearward when the damper moves from a neutral position thereof until colliding with the damper regulation unit is less than a distance that the coil moves forward when the vibrating body moves from a neutral position thereof until colliding with the magnetic circuit unit.

5. The acoustic device according to claim 1, wherein in any one of cross sections of the acoustic device including a center line that passes through a winding center of the coil, the damper regulation unit is disposed so as to be line symmetrical about the center line.

6. The acoustic device according to claim 1, wherein the damper is ring-shaped.

7. The acoustic device according to claim 1, wherein the damper regulation unit is formed as an integral part of the main body case.

8. An acoustic device comprising:

a main body case;

a vibrating body provided inside of the main body case;

a magnetic circuit unit disposed in front of the vibrating body;

a coil located inside of a magnetic gap of the magnetic circuit unit;

a cylindrical bobbin configured to support the coil and vibrate along with the vibrating body; and a damper configured to connect the main body case to the bobbin, wherein the damper is disposed in the rear of the vibrating body, wherein the inner circumference of the damper is bonded and fixed to the outer circumferential surface of the bobbin, wherein a damper regulation unit is provided in the rear of the damper at a position facing the damper and on the radially outer side of the bobbin, the amplitude of vibration of at least one of the vibrating body and the bobbin being restricted by the damper contacting the damper regulation unit, and wherein a distance that the coil moves rearward when the damper moves from a neutral position thereof until colliding with the damper regulation unit is less than a distance that the coil moves forward when the bobbin moves from a neutral position thereof until colliding with the magnetic circuit unit.

9. The acoustic device according to claim 8, further comprising:

a damper support portion to which an outer circumference of the damper is fixed, wherein a distance that the coil moves rearward when the damper moves from a neutral position thereof until colliding with the damper regulation unit is less than a distance that the coil moves rearward when the vibrating body moves from a neutral position thereof until colliding with the damper support portion.

10. The acoustic device according to claim 8, wherein a distance that the coil moves rearward when the damper moves from a neutral position thereof until colliding with the damper regulation unit is less than a distance that the coil moves forward when the vibrating body moves from a neutral position thereof until colliding with the magnetic circuit unit.

11. The acoustic device according to claim 8, wherein in any one of cross sections of the acoustic device including a center line that passes through a winding center of the coil, the damper regulation unit is disposed so as to be line symmetrical about the center line.

12. The acoustic device according to claim 8, wherein the damper is ring-shaped.

13. The acoustic device according to claim 8, wherein the damper regulation unit is formed as an integral part of the main body case.

14. An acoustic device comprising:

a main body case including a front case portion and a rear case portion;

a vibrating body provided inside of the main body case, where the vibrating body has the shape of a cone and tapers rearward;

a magnetic circuit unit fixed to a rear surface of the front case portion facing rearward and disposed in front of the vibrating body;

a coil located inside of a magnetic gap of the magnetic circuit unit;

a cylindrical bobbin configured to support the coil and vibrate along with the vibrating body; and a damper configured to connect the main body case to the bobbin, wherein the damper is disposed in the rear of the vibrating body, wherein the inner circumference of the damper is bonded and fixed to the outer circumferential surface of the bobbin, wherein a damper regulation unit is provided in the rear of the damper at a position facing the damper and on the radially outer side of the bobbin, the amplitude of vibration of at least one of the vibrating body and the bobbin being restricted by the damper contacting the damper regulation unit, and wherein a distance that the coil moves rearward when the damper moves from a neutral position thereof until colliding with the damper regulation unit is less than a distance that the coil moves forward when the vibrating body moves from a neutral position thereof until colliding with the magnetic circuit unit.

15. The acoustic device according to claim 14, further comprising:

a damper support portion to which an outer circumference of the damper is fixed, wherein a distance that the coil moves rearward when the damper moves from a neutral position thereof until colliding with the damper regulation unit is less than a distance that the coil moves rearward when the vibrating body moves from a neutral position thereof until colliding with the damper support portion.

16. The acoustic device according to claim 14, wherein a distance that the coil moves rearward when the damper moves from a neutral position thereof until colliding with the damper regulation unit is less than a distance that the coil moves forward when the bobbin moves from a neutral position thereof until colliding with the magnetic circuit unit.

17. The acoustic device according to claim 14, wherein in any one of cross sections of the acoustic device including a center line that passes through a winding center of the coil, the damper regulation unit is disposed so as to be line symmetrical about the center line.

* * * * *